United States Patent [19]

Williamson et al.

[11] 3,962,782

[45] June 15, 1976

[54] METHOD OF MAKING A MINIATURE PLUG-IN FUSE

[75] Inventors: Harold L. Williamson, Northbrook; Avinash P. Aryamane, Mt. Prospect, both of Ill.

[73] Assignee: Littelfuse, Inc., Des Plaines, Ill.

[22] Filed: Sept. 8, 1975

[21] Appl. No.: 610,978

Related U.S. Application Data

[62] Division of Ser. No. 432,980, Jan. 14, 1974, Pat. No. 3,909,767.

[52] U.S. Cl. ..... 29/623; 29/DIG. 15; 29/414; 29/417

[51] Int. Cl.[2] ..... H01H 69/02

[58] Field of Search ..... 29/623, DIG. 15, 414, 29/417; 339/62, 147 P, 208; 337/198, 187, 201, 206, 255, 262, 263, 264, 293, 295, 297

[56] References Cited

UNITED STATES PATENTS

| | | | |
|---|---|---|---|
| 1,777,916 | 10/1930 | Schaffler-Glössl | 29/623 X |
| 3,775,723 | 11/1973 | Mamrick et al. | 337/245 |
| 3,775,724 | 11/1973 | Mamrick et al. | 337/245 |

FOREIGN PATENTS OR APPLICATIONS

| | | | |
|---|---|---|---|
| 456,749 | 7/1968 | Switzerland | 29/623 |

*Primary Examiner*—Victor A. DiPalma

*Attorney, Agent, or Firm*—Wallenstein, Spangenberg, Hattis & Strampel

[57] ABSTRACT

A method is disclosed for making a plug-in fuse assembly disclosed and claimed in co-pending application Ser. No. 432,980, now U.S. Pat. No. 3,909,767, Jan. 14, 1974 for Miniature Plug-In Fuse. The method comprises the steps of providing a blank containing a pair of laterally spaced coplanar terminal forming blade portions which are interconnected by a transverse web, coplanar current carrying extensions thereof and an interconnecting fuse-forming link located in a coplanar plate-like body of a plug-in fuse element, inserting over said blank a synthetic plastic housing by way of an opening at the inwardly facing side thereof with the current carrying extensions of the blank and the interconnecting fuse-forming link within the housing and with the pair of terminal blade portions of the blank, which are interconnected by the transverse web, extending outwardly from the housing element through the opening therein, securing said blank in the synthetic plastic housing, and blanking the exposed transverse web interconnecting the terminal blade portions to complete the formation of the coplanar plate-like body having the pair of laterally spaced coplanar terminal portions and of the plug-in fuse assembly.

18 Claims, 15 Drawing Figures

FIG. 1
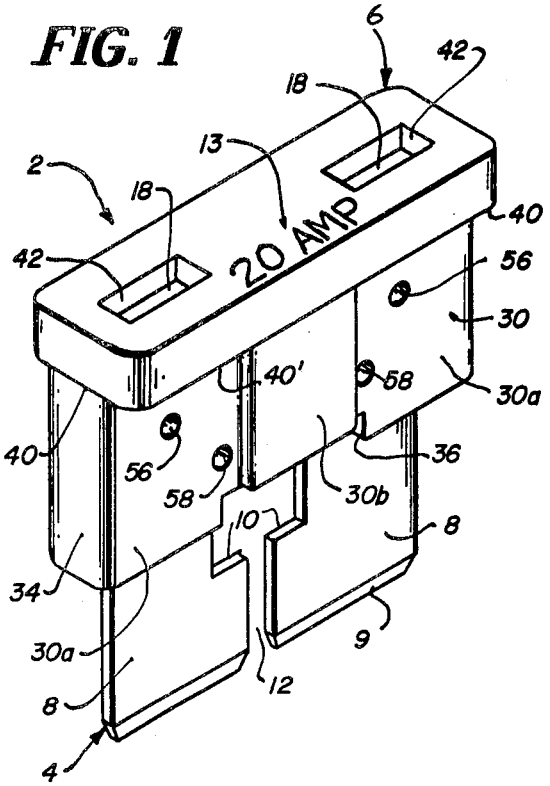
FIG. 2
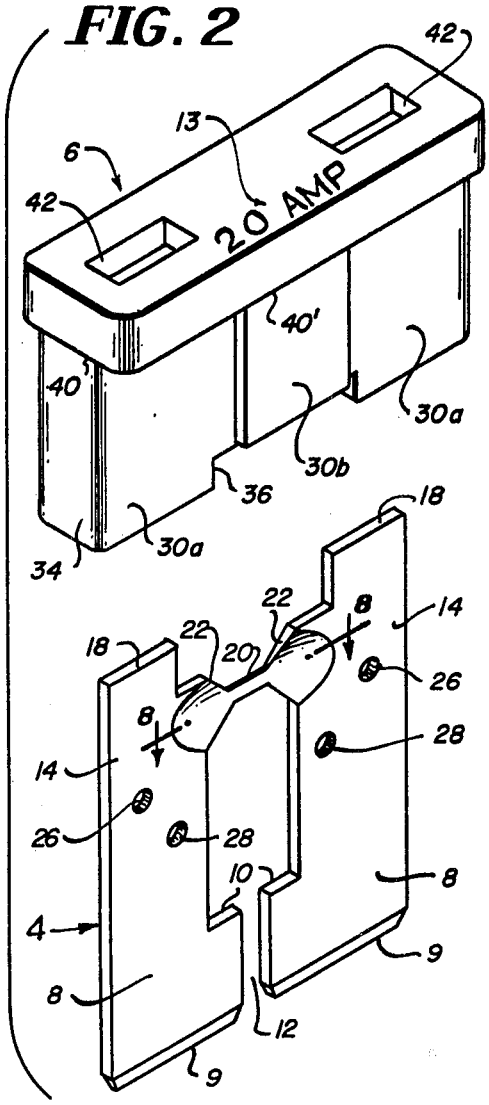
FIG. 3
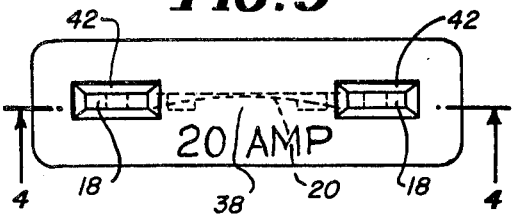
FIG. 4
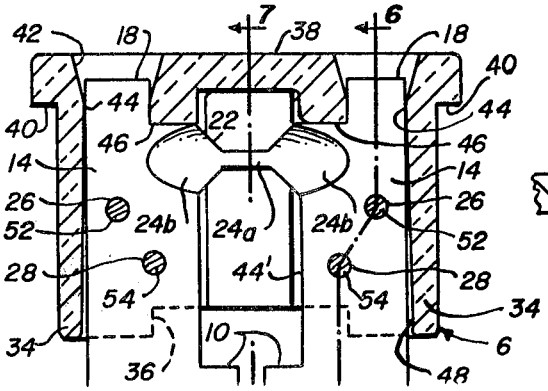
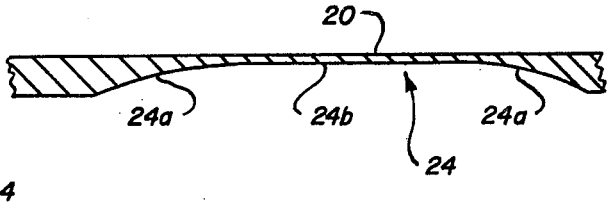
FIG. 8

FIG. 5
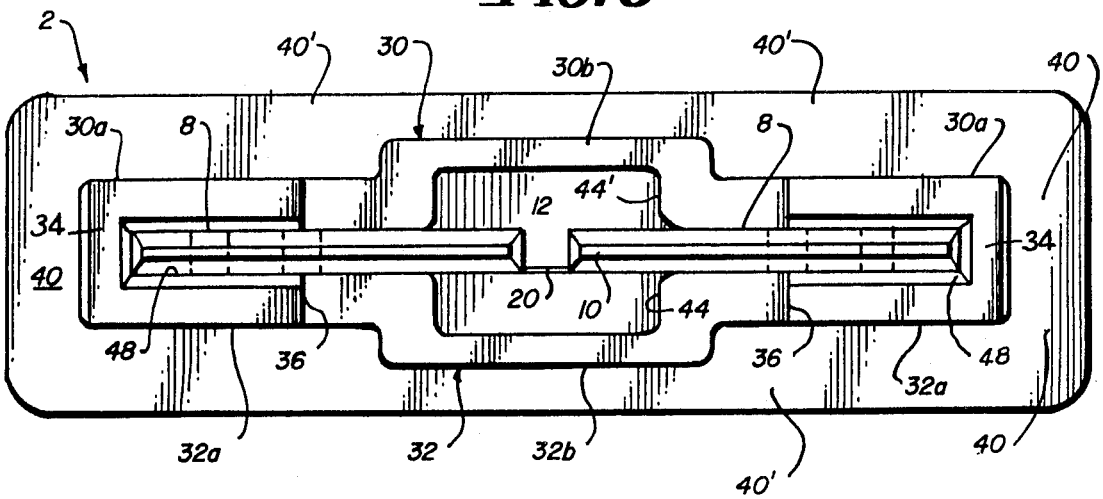
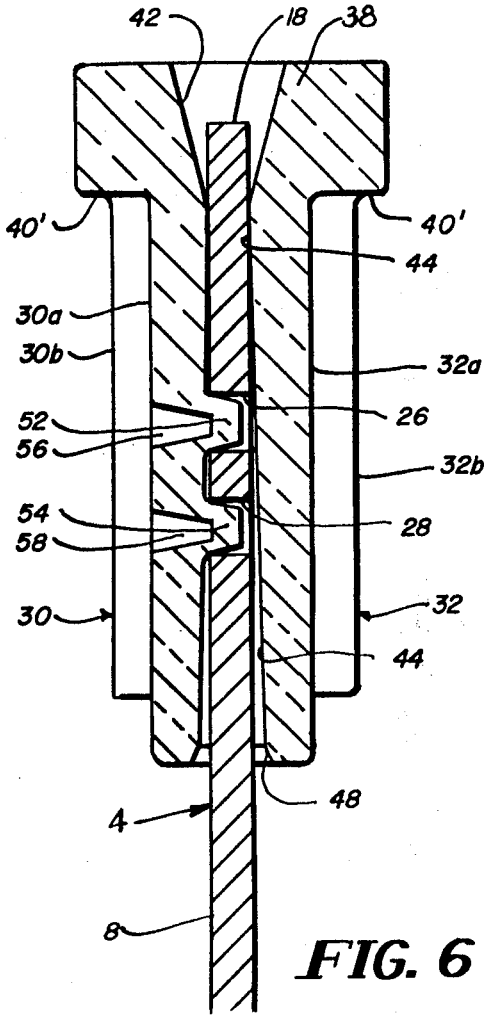
FIG. 6
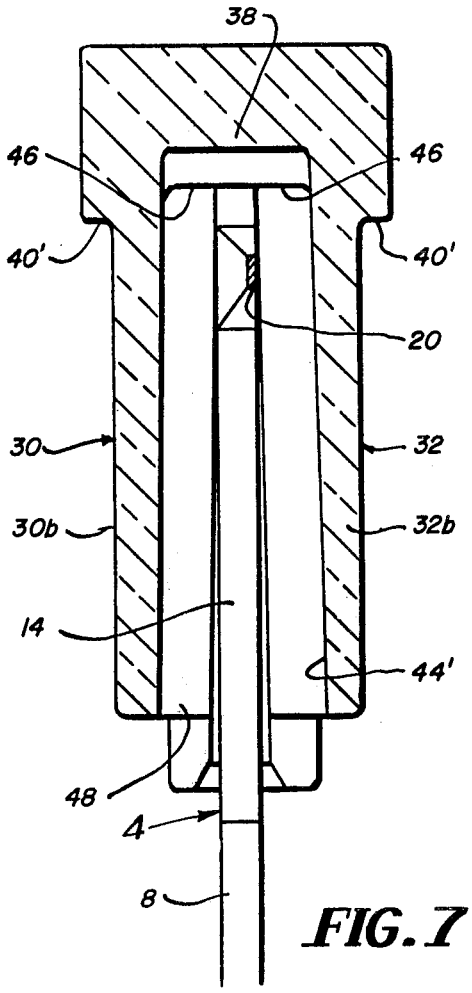
FIG. 7

FIG. 9
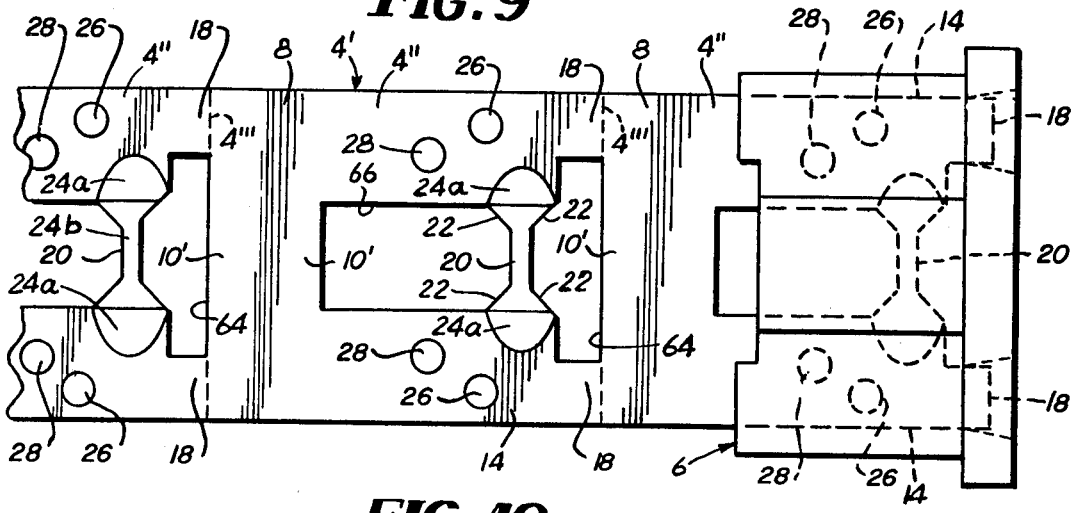
FIG. 10
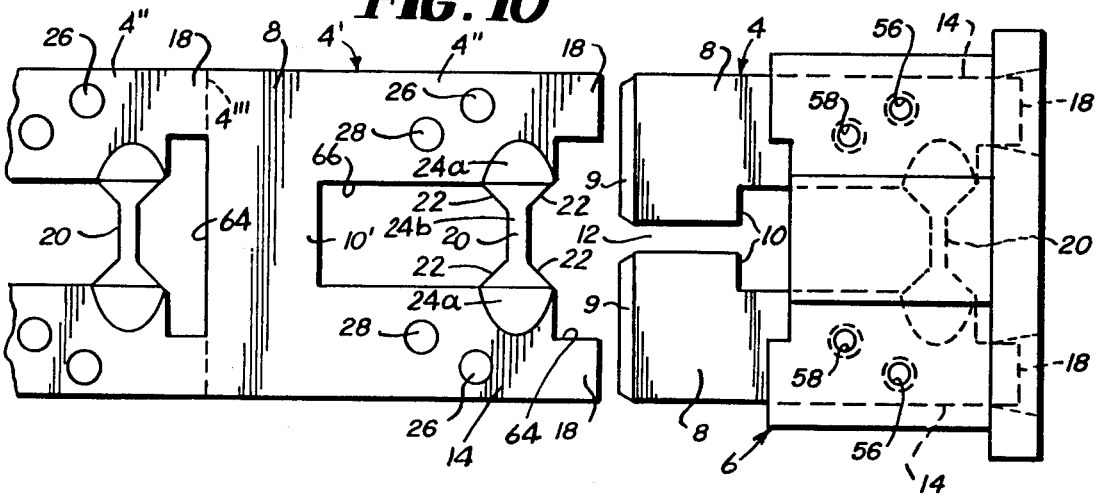
FIG. 11
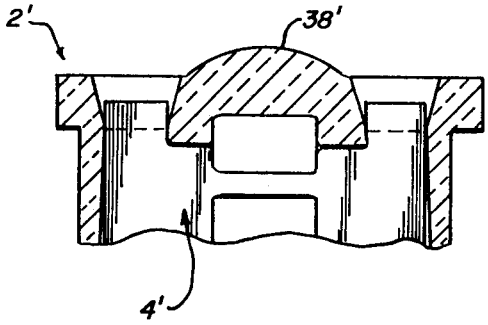
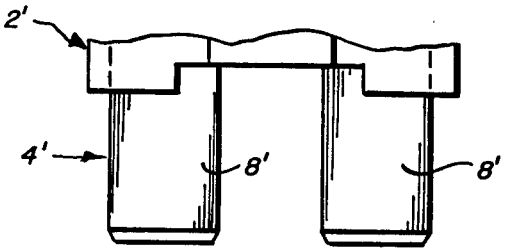
FIG. 12

METHOD OF MAKING A MINIATURE PLUG-IN FUSE

RELATED APPLICATION

This application is a division of and a continuation-in-part of application Ser. No. 432,980, now U.S. Pat. No. 3,909,767, filed Jan. 14, 1974 for Miniature Plug-In Fuse.

BACKGROUND OF THE INVENTION

The present invention relates to miniature current overload fuses which, whether they are rated to carry only a few amperes or as much as 30 amperes, occupy a space which is only a fraction of the space occupied by the conventional glass envelope cylindrical fuses.

A marked improvement in overload current fuses having a rating of from 10–30 amperes has been made where the fuse has a length well under ¾ inch and a width of under ¼ inch. Such a fuse is disclosed in U.S. Pat. No. 3,436,711. Also, the terminals of the improved fuses plug into socket openings transversely to the length of the fuse body, so the socket connector can be a much less expensive and less bulky support means than that needed for conventional high current rated fuses.

While the miniature fuses heretofore developed have been a substantial improvement over the conventional cylindrical glass envelope fuses, they still left much to be desired from the standpoint of their cost of manufacture and protection to the user. For example, in some of the miniature fuses heretofore developed, the fuse link was exposed so that the insertion thereof into a shorted circuit would blow the same and spew fuse material onto the person inserting the fuse. Also, it was possible for a person inserting or removing such a fuse to make contact with the exposed fuse link which created a shock hazard if he engaged the fuse negligently. While in one form of miniature fuse heretofore developed, as for example, that disclosed in U.S. Pat. No. 3,775,723, the fuse link was enclosed in a transparent housing having a handle extending from the outer walls thereof, the fuse was relatively expensive to manufacture and it had less reliability than the fuse of the present invention.

It is, accordingly, one of the objects of the invention to provide a method of making a miniature fuse with an enclosed fuse link and which is capable of carrying currents where desired well in excess of 10 amperes, such as up to 30 amperes, and can be manufactured at a much smaller cost than the miniature fuses heretofore designed.

A related object of the invention is to provide a method of making a miniature fuse having a housing providing an insulated gripping surface and a shield protecting the user from being contacted by the fuse material as an inserted fuse is blown.

In most of the miniature fuse designs heretofore proposed, the terminals have cylindrical pin-like configurations molded into bases of insulating material, and the fuse links were soldered between the inner ends of these terminals. The presence of solder connections sometimes created problems of reliability resulting from corrosion or hot spots due to poor solder connections or deterioration with age. Thus, another object of the present invention is to provide a method of making a miniature fuse having features satisfying one or more of the objectives previously discussed and, in addition, are devoid of the corrosion or hot spot problems referred to.

SUMMARY OF THE INVENTION

Briefly, this invention has to do with a method of making a plug-in fuse assembly as disclosed in said application Ser. No. 432,980, filed Jan. 14, 1974, and which preferably comprises a plug-in element including a coplanar plate-like body of fuse metal having a pair of laterally spaced coplanar terminal forming blade portions to be received by pressure clip terminals in a mounting panel, coplanar current carrying extensions at the inner end portions of the pair of terminal forming blade portions and a fuse-forming link portion interconnecting the current carrying extensions, and a synthetic plastic housing, which can be comprised of two confronting housing halves which can be assembled or snapped over the plug-in element, but which is preferably a one piece housing which is open at the inwardly facing side thereof, and which contains the coplanar plate-like body of the plug-in element with the current carrying extensions and the interconnecting fuse-forming link portion thereof within the housing and with the pair of terminal forming blade portions thereof extending outwardly from the housing and preferably through the opening therein.

In accordance with this invention, the method of making such a plug-in fuse assembly comprises providing a blank of fuse metal which is blanked or stamped to contain the pair of laterally spaced coplanar terminal forming blade portions which are interconnected by a transverse web, the coplanar current carrying extensions thereof and the interconnecting fuse-forming link portion involved in the coplanar plate-like body of the plug-in element.

The synthetic plastic housing is inserted over said blank of fuse metal, preferably by way of the opening at the inwardly facing side of the one piece synthetic plastic member, with the current carrying extensions and the interconnecting fuse-forming link portion of the blank within the housing and with the pair of terminal blade portions of the blank, which are interconnected by the transverse web, extending outwardly from the housing element preferably through the opening therein. The blank of fuse metal is suitably secured in the synthetic plastic housing element as by staking or the like.

The exposed transverse web interconnecting the pair of terminal blade portions adds rigidity to the blank and securely maintains the relative positions of the pair of terminal blade portions, the current carrying extensions and the interconnecting fuse forming link portion, as the synthetic plastic housing is inserted over and secured to the blank. Thus, distortion, breakage or other damage to the blank is effectively prevented during these operations. The exposed transverse web of fuse metal interconnecting the exposed terminal blade portions of the blank is then blanked or stamped out to complete the formation of the coplanar plate-like body of fuse metal having the pair of laterally spaced coplanar terminal portions and of the plug-in fuse assembly.

The blanking of the exposed transverse web interconnecting the terminal blade portions may be such as to provide the pair of exposed laterally spaced coplanar terminal portions with selected widths corresponding to the ampere rating of the plug-in fuse assembly. Also, the outer end portions of the exposed pair of terminal forming blade portions may be coined to form tapers thereon the facilitate insertion thereof into the clip terminals in mounting panel.

The blank of fuse metal is preferably initially provided with a central portion of reduced thickness so that, when the blank is blanked, the interconnecting fuse-forming link portion of the blank is of less thickness than the spaced coplanar terminal forming blade portions and the current carrying extensions. By controlling the thickness of the fuse-forming link portion and the width thereof desired selected ampere ratings for the fuse assembly may be obtained. The central portion of reduced thickness of the blank of fuse metal may be reduced by milling or by milling and subsequent squeezing.

Preferably, in providing the blanks of fuse metal, a continuous strip of fuse metal is utilized. As the strip is sequentially advanced, it is blanked to provide at spaced intervals in the strip longitudinally interconnected blanks, each containing the pair of laterally spaced coplanar terminal forming blade portions which are interconnected by the transverse web, the coplanar current carrying extensions thereof and the interconnecting fuse-forming link portion involved in the coplanar plate-like body of the plug-in element.

In this connection, the method includes serving the end blank from the sequentially advancing strip and longitudinally inserting over said end blank of the sequentially advancing strip the synthetic plastic housing with the current carrying extensions and the interconnecting fuse-forming link portion of the end blank within the housing and with the pair of terminal blade portions of the end blank, which are interconnected by the transverse web of the strip, extending outwardly from the housing through the opening therein. Said end blank of the strip is also secured in the synthetic plastic housing. As specifically disclosed herein, although not necessarily so, the inserting of the housing element over the end blank of the sequentially advancing strip and the securing of the end blank in the housing element occurs before severing the end blank from the strip.

Also, in this connection, the sequentially advanced continuous strip of fuse metal, before it is blanked, is centrally provided with reduced thickness so that when the strip is blanked, the interconnecting fuse-forming link portions of the longitudinally interconnected blanks are of less thickness than the spaced coplanar terminal forming blade portions and the current carrying extensions thereof. As specifically disclosed herein, although not necessarily so, the centrally provided reduced thickness in the strip is arranged at longitudinally spaced intervals in the strip.

Further objects of this invention reside in the particular method steps and in the cooperative relationship between the method steps in making the aforementioned plug-in fuse assembly.

Other objects and advantages of this invention will become apparent to those skilled in the art upon reference to the accompanying specification, claims and drawings.

DESCRIPTION OF THE DRAWINGS

FIG. 1 is a perspective view of a preferred form of the plug-in fuse assembly of the invention;

FIG. 2 is an exploded view of the housing and plug-in fuse element making up the plug-in fuse assembly of FIG. 1;

FIG. 3 is a top plan view of the plug-in fuse assembly of FIG. 1;

FIG. 4 is a vertical longitudinal sectional view through the fuse assembly shown in FIG. 3, taken along section line 4—4 therein;

FIG. 5 is an enlarged bottom view of the plug-in fuse assembly of FIG. 1;

FIG. 6 is an enlarged transverse vertical sectional view through the fuse assembly shown in FIG. 4, taken along section line 6—6 thereof;

FIG. 7 is an enlarged vertical transverse sectional view through the center portion of the fuse assembly shown in FIG. 4, taken along section line 7—7 thereof;

FIG. 8 is a greatly enlarged fragmentary sectional view through the fuse link portion of the plug-in fuse assembly shown in FIG. 2, taken along section line 8—8 thereof, and showing the manner in which the fuse-forming link portion thereof is reduced in thickness by a combination milling and pressing operation;

FIG. 9 illustrates the insertion of the housing of the fuse assembly of FIGS. 1–8 onto the end of a pre-milled and prestamped strip of fuse metal from which number of plug-in fuse elements like that shown in these figures are formed;

FIG. 10 shows the separation of a completed plug-in fuse assembly from the strip shown in FIG. 9, after a strip staking and severing operation has been carried out;

FIG. 11 illustrates a fragmentary longitudinal sectional view through a portion of a plug-in fuse assembly like that shown in FIGS. 1–10 but which has been modified by adding a magnifying lens to the outer wall of the housing thereof;

FIG. 12 illustrates a fragmentary side elevational view of a plug-in fuse assembly modified from that shown in FIGS. 1–11 in that the wings on the terminal-forming blade portions of the plug-in fuse element have been removed to indicate a lower current rated fuse.

DESCRIPTION OF THE PREFERRED EMBODIMENT OF THE INVENTION

Figure 13:
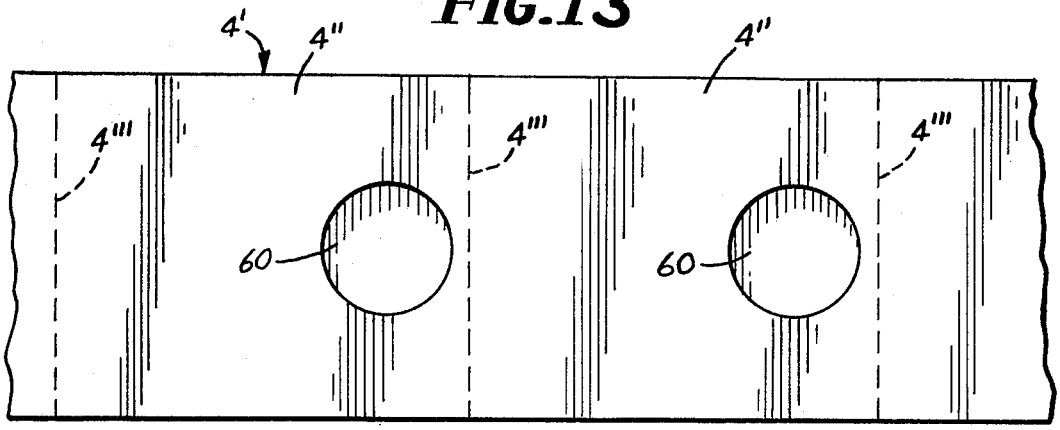
FIG. 13 illustrates the milling of the strip before it is blanked or stamped as illustrated in FIGS. 9 and 10.
Figure 14:
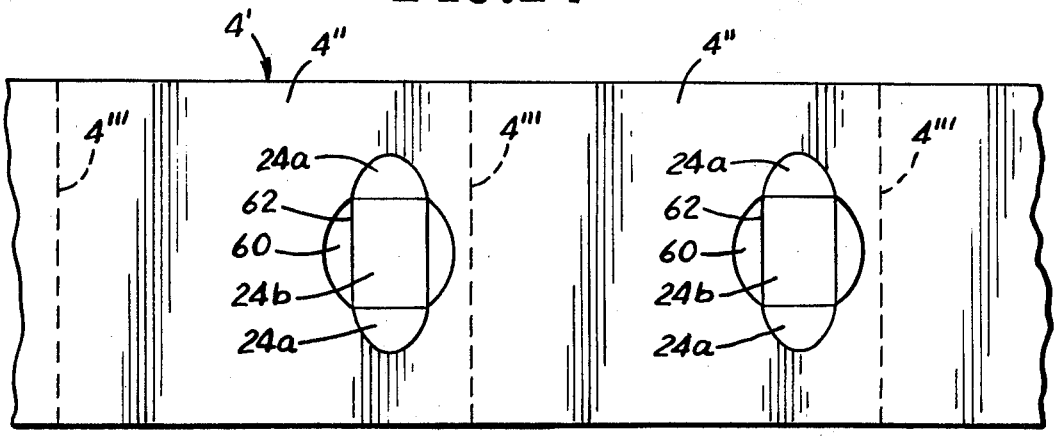
FIG. 14 illustrates the milled strip of FIG. 13 after it is squeezed or compressed and before it is blanked or stamped as illustrated in FIGS. 9 and 10.

Referring now more particularly to FIGS. 1–4, there is shown a plug-in fuse assembly 2 made of only two component parts, namely a plug-in fuse element 4 which most advantageously is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking operation to be described.

The plug-in fuse element 4 has terminal-forming blade portions 8-8 extending in spaced parallel relationship from the inner or bottom margin of the housing 6 in what will be referred to as a downward or inwardly extending direction. The ends of the terminal-forming blade portions 8—8 of the plug-in fuse element are most advantageously tapered at 9—9 to form pointed end portions which readily slip into place between the confronting walls of conventional spring clip terminals (not shown) supported in mounting panel apertures. The terminal-forming blade portions 8—8 of the plug-in fuse element 4 have inwardly extending rough current rating indicating wings or projections 10—10, to provide a more massive appearance to the exposed terminal-forming portions 8—8 of the plug-in fuse element 4, identifying the fact that the fuse assembly is one having a relatively high current rating, such as in the range of from 20 to 30 amps. (The exact current rating is indicated by indicia 13 on the outer walls of the housing as shown in FIGS. 1—3. Where a plug-in fuse element has a relatively low current rating such as 5 to 15 amperes, the wings 10—10 are eliminated so the user knows immediately that the plug-in element which does not have any wings is for a lower current rated application. Such a plug-in fuse element is shown in FIG. 12.)

The plug-in fuse element 4 is stamped from a strip 4' of fuse metal (FIGS. 9 and 10 and 13 to 15). Prior to the plug-in fuse element being severed from the strip 4', the wings 10—10 are interconnected to form a transverse rigidifying web 10' for the strip 4', and so a narrow piece of material is stamped from the transverse web 10' to form the terminal-forming blade portions 8—8 and a gap 12 between the same. The tapered portions 9—9 of the terminal-forming blade portions 8—8 may be formed by coining dies (not shown) during the operation which severs the plug-in fuse element from the strip or preferably thereafter.

The terminal-forming blade portions 8—8 have current carrying extensions 14—14 projecting into the aforementioned space formed by the housing 6, which current-carrying extensions project well up into the upper or outer extremities of the housing 6, to be contiguous to the front or outer wall of the housing to be described. The outer end portions of the current-carrying extensions 14—14 are interconnected by a fuse-forming link portion 20 which is preferably both narrower in width and much smaller in thickness than the outer current-carrying portions of the plug-in fuse element 4. The current-carrying capacity of the fuse-forming link portion 20 may be varied by varying the fuse metal composition or by varying the width and/or the thickness of the fuse-forming link portion. In the particular configuration of the plug-in fuse element 4 shown in the drawings the current carrying extensions 14—14 join the fuse-forming link portion 20 of the plug-in fuse element 4 by tapered portions 22—22. All of the various parts of the plug-in fuse element are substantially in coplanar relation so no metal bending operations need be performed in the process of making the same.

It was found that a reduction portion the thickness of the metal of the fuse-forming link portin 20 is preferably achieved by a milling operation which mills away the metal on one side thereof to form a generally curved depression 24 best shown in FIG. 8. The outer portions of this depression 24 are identified by reference numerals **24*a*—24*a* and may represent the milled surfaces. The flattened intermediate portion 24*b* of the depression 24 may be obtained by squeezing or pressing the metal to further reduce this thickness thereof. On the other hand, following an initial milling step, both the curved outer portions 24*a*—24*a* and the flattened intermediate portion 24*b* of the depression 24 may be attained by squeezing or pressing. For example, it was found that in one plug-in fuse element, the thickness of the fuse metal was reduced from an initial thickness of 0.027 inches to about 0.005 inches by a milling operation, and a further reduction of 0.002 inches was achieved by a pressing operation, ending up with a minimum thickness of the fuse-forming link portion 20 of 0.003 inches. Of course, the precise thickness of the fuse metal depends upon the fuse metal composition, the width of the fuse-forming link portion 20** and the desired current rating of the fuse.

While the plug-in fuse element 4 may be used as a fuse element without its incorporation in the housing 6, for safety reasons it is preferred to incorporate the plug-in fuse element 4 in the housing 6. To this end, and for reasons to be explained, the outer end portions of the terminal extensions 14—14 are provided with outwardly or upwardly projecting tabs 18—18 adapted to make contact with test probes to test for the continuity of the fuse-forming link portion 20 of the plug-in fuse element 4. Also, to anchor the plug-in fuse element 4 within the housing 6, anchoring apertures 26—26 and 28—28 are respectively formed in the terminal extension 14—14 to receive anchoring projections to be described formed in the housing walls.

While the housing 6 could be made in two separate parts snappable together, the housing is most advantageously a single piece molded part as previously indicated. Also, it preferably has a narrow elongated configuration formed by relatively closely spaced side walls generally indicated by reference numeral 30–32, the side walls having end portions **30*a*–32*a* and 30*a*–32*a* which are spaced together much more closely than the central or intermediate portions 30*b*–32*b* thereof. The side walls 30–32 are interconnected at their end margins by narrow end walls 34–34, and at their outer or top margins by an outer wall 38 which overhangs the rest of the housing to form downwardly facing shoulders 40—40 at the longitudinal ends of the outer wall 38 and downwardly facing shoulders 40'—40' along the longitudinal side margins of the housing 6. The shoulders 40'—40' are coplanar continuations of the shoulders 40—40 at the ends of the housing 6.**

Terminal access openings 42—42 are provided in the outer wall 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test probes can be guided into contact with the tabs 18—18. The terminal access openings 42—42 communicate with the aforementioned plug-in fuse element receiving space in the housing 4. The portions 44—44 of this space immediately beneath the access openings 42—42 are relatively small because of the close spacing of the side wall portions **30*a*—32*a* of the housing at these points, the width of the space portions 44—44 as viewed in FIG. 6 tapering from the bottom open end of the housing upwardly toward the terminal access openings 42—42, reaching a narrow dimension about equal to the thickness of the plug-in fuse element 4. At the inner margins of the terminal access openings 42—42 the upper wall 38 is provided with downwardly extending skirts 46—46 which act as shield walls preventing spewing fuse metal from gaining entrance to the terminal access openings 42—42. These shield forming skirts 46—46 also act as stop or abutment shoulders for the current-carrying extensions 14—14 of the terminal-forming blade portions 8—8** of the plug-in fuse element.

The fuse-forming link portion 20 of the fuse element 4 is positioned in a relatively wide portion 44' (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44' of the space within the housing 6 open onto the bottom of the housing for the full extent thereof through an entry opening 48. The opening 48 permits the housing to be pushed over the end portion or end blank of the pre-stamped and milled strip 4' from which a completed fuse element is punched immediately following the securing of the housing 6 to the end portion or end blank of the strip as previously indicated.

The housing 6 is preferably a molded part made of a transparent synthetic plastic material so that the fuse-forming filament portion 20 of the plug-in fuse element 4 is readily visible through the intermediate portion of the outer wall 38, to which the fuse-forming link portion 20 is in spaced but relatively contiguous relation. The housing is preferably molded of a high temperature transparent nylon made by Belding Chemical Industries of New York City, New York (Product Code No. LX-3330).

While the housing interior 6 could be made with resilient projections which snap into the anchoring apertures 26—26 and 28—28 in the plug-in fuse element 4, it is preferred to secure the housing in place by forming projections 52 and 54, by a cold staking operation, ultrasonic melting or other operation, which enter the anchoring apertures 26—26 and 28—28 of the plug-in fuse element 4. The depressions 56 and 58 left by a staking operation are shown in the side wall 30 in FIGS. 1 and 6.

To improve the visibility of the fuse-forming link portion 20 of the plug-in fuse element, the outer wall of the housing of the fuse assembly can be modified as shown in FIG. 11 where the housing outer wall 38' of a modified fuse assembly 2' is thickened and curved to form a magnifying lens. Also, as shown in FIG. 12, the fuse assembly 2' is a low current rated fuse assembly as evidenced by the absence of wings on the terminal-forming blade portion 8'—8' on the plug-in fuse element 4'.

The exemplary embodiments of the invention just described have thus provided an exceedingly reliable, compact and inexpensive to manufacture plug-in fuse assembly which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse-forming link portion of the plug-in fuse element can be viewed when the plug-in fuse assembly is mounted on the mounting panel. The terminal access openings enable test equipment to test the continuity of the fuse if the user does not desire to rely solely on a visual observation of the fuse-forming link portion of the fuse. The presence or absence of wings on the terminal-forming blade portion of the plug-in fuse element immediately informs the user whether he has selected a relatively high or low current rated fuse, although the indicia 13 should be examined to determine the actual current rating.

The preferred method of making the plug-in fuse assembly is illustrated in FIGS. 13, 14, 15, 9 and 10. It includes providing a continuous strip 4' of a fuse metal which is sequentially advanced the distance of a blank 4'' between distances 4''' as indicated in dotted lines in these figures. In FIG. 13 the strip 4' is provided at spaced intervals with a milled portion 60, the milled portion 60 being provided in the appropriate place in each blank 4''. Thereafter, at each milled portion 60 each blank is squeezed or compressed as indicated at 62 in FIG. 14 to provide by squeezing or pressing a depression in the blank having curved surfaces **24*a*—24*a* and a flattened intermediate portion 24*b* as referred to above in connection with FIG. 8.**

Figure 15:
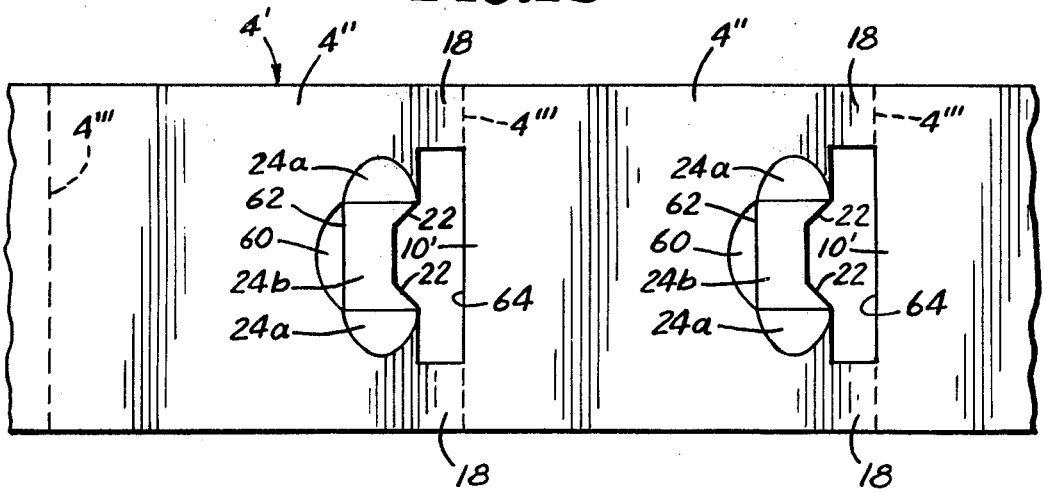
FIG. 15 illustrates the milled and squeezed strip of FIG. 14 after it has been partially blanked or stamped and before it is completely blanked or stamped as illustrated in FIGS. 9 and 10 in the event that it should be desirable to utilize two progressive stages of blanking or stamping instead of a single stage.

After the appropriate depression is formed in each blank 4'', the advancing strip 4' is then blanked to form the terminal portions 8, the current carrying extensions 14 thereof and the further extensions 18 thereof. This may be accomplished in one blanking operation or in a plurality of blanking operations. As illustrated herein, the blanking operation is accomplished in two steps. The first blanking step in the sequentially advancing strip 4' is illustrated in FIG. 15 wherein each blank 4'' is sequentially blanked as indicated at 64 to provide the extensions 18 and a portion of the fuse link 20 having the tapered portions 22. Thereafter, each blank is sequentially blanked as illustrated in FIG. 9 at 66 to provide the current carrying extensions 14 and the other part of the fuse link 20 extending between the current carrying extensions 14 having the tapered portions 22. During this same blank ing operation the interlocking holes 26 and 28 are also blanked. In this blanking operation the transverse web 10' still remains between the terminal forming blade portions 8 of each blank.

As shown in FIG. 9, the housing 6 is inserted over the end blank 4'' to receive the current carrying extensions 14 and the fuse link 20 within the housing and with the terminal forming blade portions 8 still interconnected by the transverse web 10' extending from the housing. The housing is then cold staked and/or ultrasonically secured in the interlock openings 26 and 28 of the end blank 4'' as indicated at 56, 58 in FIGS. 6 and 10. Preferably, the placing of the housing 6 over the end blank 4'' and securing the housing to the end blank occurs before severing the end blank from the strip at the blank edge 4'''. In FIG. 10 the end blank 4'' and its housing 6 are severed from the strip 4' at the blank edge 4''' of the end of blank 4'' to form the substantially completed plug-in fuse assembly, but with the transverse web 10' still intact. Thereafter, the transverse web 10' is blanked at 12 to provide the spaced apart terminal forming blade portions 8 as indicated at FIG. 10. Here, the blanking of the transverse web may provide wings 10 as illustrated in FIG. 10 or the wings may be eliminated as illustrated in FIG. 12. Thereafter, the ends of the terminal forming blade portions 8 may be coined as illustrated at 9 to form tapered ends for the blade portions. In this way, the complete plug-in fuse assembly as illustrated in FIGS. 10 and 1 may be provided.

While for purposes of illustration herein one preferred specific method of making the plug-in fuse assembly has been disclosed herein, other methods may become apparent to those skilled in the art and therefore this invention is to be limited only by the scope of the appended claims.

We claim:

1. The method of making a plug-in assembly comprising a plug-in element including a coplanar plate-like body means having a pair of laterally spaced coplanar terminal forming blade portions to be received by pressure clip terminals in a mounting panel and coplanar current carrying extensions at the inner end portions of the pair of terminal forming blade portions, and a synthetic plastic housing which is open at the inwardly facing side thereof and which contains the coplanar plate-like body means of the plug-in element with the current carrying extensions thereof within the housing and with the pair of terminal forming blade portions thereof extending outwardly therefrom through the opening therein, said method comprising the steps of providing a blank containing the pair of laterally spaced coplanar terminal forming blade portions which are interconnected by a transverse web and the coplanar current carrying extensions thereof involved in the coplanar plate-like body means of the plug-in element, inserting over said blank the synthetic plastic housing by way of the opening at the inwardly facing side thereof with the current carrying extensions of the blank within the housing and with the pair of terminal blade portions of the blank, which are interconnected by the transverse web, extending outwardly from the housing through the opening therein, securing said blank in the synthetic plastic housing, and blanking the exposed transverse web interconnecting the terminal blade portions to complete the formation of the coplanar plate-like body means having the pair of laterally spaced coplanar terminal portions and of the plug-in assembly.

2. The method as defined in claim 1 wherein the synthetic plastic housing also has a pair of access openings in the outwardly facing side thereof to provide access to the current carrying extensions of the plug-in element within the housing, and wherein the current carrying extensions of the blank are positioned in the housing adjacent the pair of access openings when the housing is inserted over the blank.

3. The method of making a plug-in fuse assembly comprising a plug-in element including a coplanar plate-like body having a pair of laterally spaced coplanar terminal forming blade portions to be received by pressure clip terminals in a mounting panel, coplanar current carrying extensions at the inner end portions of the pair of terminal forming blade portions and a fuse-forming link interconnecting the current carrying extensions, and a synthetic plastic housing which contains the coplanar plate-like body of the plug-in element with the current carrying extensions and the interconnecting fuse-forming link thereof within the housing and with the pair of terminal forming blade portions thereof extending outwardly therefrom, said method comprising the steps of providing a blank containing the pair of laterally spaced coplanar terminal forming blade portions which are interconnected by a transverse web and the coplanar current carrying extensions thereof and the interconnecting fuse-forming link involved in the coplanar plate-like body of the plug-in element, inserting over said blank the housing with the current carrying extensions of the blank and the interconnecting fuse-forming link within the housing and with the pair of terminal blade portions of the blank, which are interconnected by the transverse web, extending outwardly from the housing, securing said blank in the housing, and blanking the exposed transverse web interconnecting the terminal blade portions to complete the formation of the coplanar plate-like body having the pair of laterally spaced coplanar terminal portions and of the plug-in fuse assembly.

4. The method as defined in claim 3 wherein the synthetic plastic housing is a single piece housing and has an opening at the inwardly facing side thereof, and said housing is inserted over said blank by way of the opening at the inwardly facing side thereof.

5. The method of making a plug-in fuse assembly comprising a plug-in element including a coplanar plate-like body of fuse metal having a pair of laterally spaced coplanar terminal forming blade portions to be received by pressure clip terminals in a mounting panel, coplanar current carrying extensions at the inner end portions of the pair of terminal forming blade portions and a fuse-forming link portion interconnecting the current carrying extensions, and a synthetic plastic housing which contains the coplanar plate-like body of the plug-in element with the current carrying extensions and the interconnecting fuse-forming link portion thereof within the housing and with the pair of terminal forming blade portions thereof extending outwardly therefrom, said method comprising the steps of providing a blank of fuse metal which is blanked to contain the pair of laterally spaced coplanar terminal forming blade portions which are interconnected by a transverse web, the coplanar current carrying extensions thereof and the interconnecting fuse-forming link portion involved in the coplanar plate-like body of the plug-in element, inserting over said blank of fuse metal the synthetic plastic housing with the current carrying extensions and the interconnected fuse-forming link portion of the blank within the housing and with the pair of terminal blade portions of the blank, which are interconnected by the transverse web, extending outwardly from the housing, securing said blank of fuse metal in the synthetic plastic housing, and blanking the exposed transverse web of fuse metal interconnecting the terminal blade portions to complete the formation of the coplanar plate-like body of fuse metal having the pair of laterally spaced coplanar terminal portions and of the plug-in fuse assembly.

6. The method as defined in claim 5 wherein the blank of fuse metal is initially provided with a central portion of reduced thickness so that, when the blank is blanked, the interconnecting fuse-forming link portion of the blank is of less thickness than the spaced coplanar terminal forming blade portions and the current carrying extensions thereof.

7. The method as defined in claim 6 wherein the central portion of reduced thickness of the blank of fuse metal is reduced by milling.

8. The method as defined in claim 6 wherein the central portion of reduced thickness of the blank of fuse metal is reduced by milling and subsequent squeezing.

9. The method as defined in claim 5 wherein the blank, where it is received within the housing, has interlock openings, and wherein the synthetic plastic housing is staked into the interlock openings in the blank for securing the blank in the synthetic plastic housing.

10. The method as defined in claim 9 wherein the synthetic plastic housing is ultrasonically heated where it is staked into the interlock openings in the blank.

11. The method as defined in claim 5 including the step of coining the outer end portions of the pair of terminal forming blade portions.

12. The method of making a plug-in assembly comprising a plug-in element including a coplanar plate-like body means having a pair of laterally spaced coplanar terminal forming blade portions to be received by pressure clip terminals in a mounting panel and coplanar current carrying extensions at the inner end portions of the pair of terminal forming blade portions, and a synthetic plastic housing which is open at the inwardly facing side thereof and which contains the coplanar plate-like body means of the plug-in element with the current carrying extensions thereof within the housing and with the pair of terminal forming blade portions thereof extending outwardly therefrom through the opening therein, said method comprising the steps of providing a continuous strip from which the coplanar plate-like body means are to be formed, sequentially advancing the continuous strip, blanking said continuous strip as it is being sequentially advanced to provide at spaced intervals in said strip longitudinally interconnected blanks contains the pair of laterally spaced coplanar terminal forming blade portions which are interconnected by a transverse web of the strip and the coplanar current carrying extensions thereof involved in the coplanar plate-like body means of the plug-in element, severing the end blank from the sequentially advancing strip and longitudinally inserting over said end blank of the sequentially advancing strip the synthetic plastic housing by way of the opening at the inwardly facing side thereof with the current carrying extensions of the end blank within the housing and with the pair of terminal blade portions to the end blank, which are interconnected by the transverse web of the strip, extending outwardly from the housing through the opening therein, securing said end blank of the sequentially advancing strip in the synthetic plastic housing, and blanking the exposed transverse web of the strip interconnecting the terminal blade portions to complete the formation of the coplanar plate-like body means having the pair of laterally spaced coplanar terminal portions and of the plug-in assembly.

13. The method as defined in claim 12 wherein inserting the synthetic plastic housing over the end blank of the sequentially advancing strip occurs before severing said end blank from the sequentially advancing strip.

14. The method as defined in claim 12 wherein securing the end blank of the sequentially advancing strip in the synthetic plastic housing occurs before severing said end blank from the sequentially advancing strip.

15. The method of making a plug-in fuse assembly comprising a plug-in element including a coplanar plate-like body having a pair of laterally spaced coplanar terminal forming blade portions to be received by pressure clip terminals in a mounting panel, coplanar current carrying extensions at the inner end portions of the pair of terminal forming blade portions and a fuse-forming link interconnecting the current carrying extensions, and a synthetic plastic housing which contains the coplanar plate-like body of the plug-in element with the current carrying extensions and the interconnecting fuse-forming link thereof within the housing and with the pair of terminal forming blade portions thereof extending outwardly therefrom, said method comprising the steps of providing a continuous strip from which the coplanar plate-like bodies are to be formed, sequentially advancing the continuous strip, blanking said continuous strip as it is being sequentially advanced to provide at spaced intervals in said strip longitudinally interconnected blanks containing the pair of laterally spaced coplanar terminal forming blade portions which are interconnected by a transverse web of the strip, the coplanar current carrying extensions thereof and the interconnecting fuse-forming link involved in the coplanar plate-like body of the plug-in element, severing the end blank from the sequentially advancing strip and inserting over said end blank of the sequentially advancing strip the housing with the current carrying extensions of the end blank and the interconnecting fuse-forming link within the housing and with the pair of terminal blade portions of the end blank, which are interconnected by the transverse web of the strip, extending outwardly from the housing, securing said end blank of the sequentially advancing strip in the housing, and blanking the exposed transverse web of the strip interconnecting the terminal blade portions to complete the formation of the coplanar plate-like body having the pair of laterally spaced coplanar terminal portions and of the plug-in fuse assembly.

16. The method of making a plug-in fuse assembly comprising a plug-in element including a coplanar plate-like body of fuse metal having a pair of laterally spaced coplanar terminal forming blade portions to be received by pressure clip terminals in a mounting panel, coplanar current carrying extensions at the inner end portions of the pair of terminal forming blade portions and a fuse-forming link portion interconnecting the current carrying extensions, and a synthetic plastic housing which contains the coplanar plate-like body of the plug-in element with the current carrying extensions and the interconnecting fuse-forming link portion thereof within the housing and with the pair of terminal forming blade portions thereof extending outwardly therefrom, said method comprising the steps of providing a continuous strip of fuse metal from which the coplanar plate-like bodies are to be formed, sequentially advancing the continuous strip of fuse metal, blanking said continuous strip of fuse metal as it is being sequentially advanced to provide at spaced intervals in said strip longitudinally interconnected blanks containing the pair of laterally spaced coplanar terminal forming blade portions which are interconnected by a transverse web of the strip of fuse metal, the coplanar current carrying extensions thereof and the interconnecting fuse-forming link portion involved in the coplanar plate-like body of the plug-in element, severing the end blank from the sequentially advancing strip of fuse metal and inserting over said end blank of the sequentially advancing strip of fuse metal the synthetic plastic housing with the current carrying extensions and the interconnecting fuse-forming link portion of the end blank within the housing and with the pair of terminal blade portions of the end blank, which are interconnected by the transverse web of the strip, extending outwardly from the housing, securing said end blank of the sequentially advancing strip of fuse metal in the synthetic plastic housing, and blanking the exposed transverse web of the strip of fuse metal interconnecting the terminal blade portions to complete the formation of the coplanar plate-like body having the pair of laterally spaced coplanar terminal portions and of the plug-in fuse assembly.

17. The method as defined in claim 16 wherein the sequentially advanced continuous strip of fuse metal before it is blanked is centrally provided with reduced thickness so that when the strip of fuse metal is blanked, the interconnecting fuse-forming link portions of the longitudinally interconnected blanks are of less thickness than the spaced coplanar terminal forming blade portions and the current carrying extensions thereof.

18. The method as defined in claim 17 wherein the centrally provided reduced thickness in the strip of fuse metal is arranged at longitudinally spaced intervals in the strip.

* * * * *